US006194112B1

(12) United States Patent
Ahuja et al.

(10) Patent No.: US 6,194,112 B1
(45) Date of Patent: Feb. 27, 2001

(54) CARRIER COATING PROCESSES

(75) Inventors: Suresh K. Ahuja; Richard B. Mcgriff; Timothy J. Waldnig, all of Webster; Deepak R. Maniar, Penfield; Robert A. Gill, Webster; Kevin Marcell, Rochester, all of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/411,576

(22) Filed: Oct. 4, 1999

(51) Int. Cl.[7] ..... G03G 9/113

(52) U.S. Cl. ..... 430/108; 430/137; 427/216

(58) Field of Search ..... 430/108, 137; 427/216, 212

(56) References Cited

U.S. PATENT DOCUMENTS 3,935,339 * 1/1976 Cooke ..... 427/216
5,491,042 * 2/1996 Sato et al. ..... 430/108

* cited by examiner

*Primary Examiner*—John Goodrow
(74) *Attorney, Agent, or Firm*—John L. Haack

(57) ABSTRACT

A process including: heating resin coated core particles for a time until the weight average molecular weight of the resin coating declines.

18 Claims, No Drawings

CARRIER COATING PROCESSES

REFERENCE TO COPENDING AND ISSUED PATENTS

Attention is directed to commonly owned and assigned U.S. Pat. No. 5,015,550, issued May 14, 1991, and U.S. Pat. No. 4,935,326, issued Jun. 19, 1990 to Creatura et al., respectively entitled "Electrophotographic coated carrier particles and methods thereof", and "Electrophotographic carrier particles coated with polymer mixture" which patents disclose carrier and developer compositions, and a process for the preparation of carrier particles with substantially stable conductivity parameters which comprises (1) providing carrier cores and a polymer mixture, (2) dry mixing the cores and the polymer mixture, (3) heating the carrier core particles and polymer mixture, whereby the polymer mixture melts and fuses to the carrier core particles; and (4) thereafter cooling the resulting coated carrier particles.

The disclosure of the above mentioned patents are incorporated herein by reference in their entirety. The appropriate components and processes of those patent applications may be selected for the products and processes of the present invention in embodiments thereof.

BACKGROUND OF THE INVENTION

The present invention is generally directed to processes for the preparation of resin coated particulate materials, for example, carrier particles for use in two component xerographic developers. More specifically, the present invention relates to improved coating processes for the preparation of polymer coated carrier core particles.

Dry polymer coating processes for carrier particles are known in the art, reference for example, the aforementioned commonly owned U.S. Pat. Nos. 5,015,550, and 4,935,326.

The aforementioned references are incorporated in their entirety by reference herein.

In polymer particle coating processes of the prior art, various significant problems exist, for example difficulties in predicting or controlling, for example, the tribo and conductivity of the carrier. Some of the prior art coatings have a tendency to separate from the core in the form of chips or flakes. These flakes can have an adverse effect on the triboelectric charging properties of the developer. Another problem is fluctuations in the charge characteristics with changes in the relative humidity.

These and other disadvantages are avoided, or minimized with the coating processes of the present invention.

There remains a need for simple and economical coating processes for the preparation of resin coated carrier core particles wherein the resulting resin coated particles possess superior performance properties, such as tribo charging and durability, when used in, for example, two component developers.

The processes and products of the instant invention are useful in many applications, for example, including toner resins used for electrophotographic imaging processes, particularly color imaging, and for use, for example, in thermoplastic films and coating technologies.

SUMMARY OF THE INVENTION

Embodiments of the present invention, include:

A process comprising:

heating resin coated core particles for a time until the weight average molecular weight of the resin coating declines;

A resin coated carrier prepared by the process comprising:

heating resin coated core particles for a time until the weight average molecular weight of the resin coating decreases; and A developer comprising the aforementioned resin coated carrier particles having coating resins with thermally diminished molecular weights, and toner particles.

These and other embodiments of the present invention are illustrated herein.

DETAILED DESCRIPTION OF THE INVENTION

The particle coating processes of the present invention may be used to process and prepare a variety of particulate and polymeric materials, including carrier core particles for used in liquid and dry developer marking applications in a cost efficient manner. An advantage of the present invention is that the processes affords control over the coating and surface properties of the resulting coated particulate products, and control over the triboelectric charging properties of the resulting coated core particles.

In embodiments, the present invention provides processes for the preparation of resin coated particles comprising:

heating resin coated core particles for a time so that or until the weight average molecular weight of the resin coating declines.

The weight average molecular weight decline or decrease can be, for example, from about 1 to about 90 percent, and preferably from about 2 to about 50 percent. The heating time or period can be, for example, from about 1 minutes to about 10 hours, and preferably from about 5 minutes to about 60 minutes, and can depend, for example, most importantly on the molecular weight and the charge properties desired of the resulting coated carrier particles, on the heating apparatus used, the scale of the process, heating temperature, the polymer or polymers selected, and the like parameters The resulting coated core particles can possess a resin coating with a substantially uniform thickness and excellent coating adhesion to the core, and the coated core particles possess improved or optimized triboelectric charge properties.

In an illustrative example, when the coating resin is a polymethylmethacrylate polymer and the core particles are steel, there is produced modified resin coated core particles where the triboelectric charge of the resulting coated core particles is in a range of from about 30 to about 45 microcoulombs per gram, whereas the triboelectric charge of the coated core particles before heating is a range of about 10 to about 60 microcoulombs per gram. The thickness of the resin coating of the resulting polymethylmethacrylate coated core particles can be, for example, from about 0.01 to about 0.5 microns, and preferably from about 0.01 to about 0.1 microns. The weight average molecular weight of the polymethylmethacrylate prior to heating can be from about 350,000 to about 450,000, and the molecular weight distribution or polydispersity can be about 4.0 to about 6.0 wherein the weight average molecular weight of the polymethylmethacrylate after heating can be from about 70,000 to about 140,000, and the molecular weight distribution can be from about 2.0 to about 4.0.

The modification and improvement of the coating properties and of the resulting resin coated core particles, while not desired to be limited by theory, is believed to result from either or both a molecular level change in the coating resin, such as molecular weight and or molecular weight distribution, and dependent and independent changes in the physical properties of the resin coating. In embodiments, the heating can be accomplished at from about 190° C. to about 270° C., more preferably from about 200° C. to about 260° C., and most preferably from about 210° C. to about 250° C. The preferences arise from experimental results which suggest that temperatures below the lower temperature limits may not effect the desired result or do so at a rate which is industrially inefficient, whereas temperatures above or outside the upper temperature limits appear to produce defective or less desirable coated products with, for example, unsatisfactory tribo properties, inadequate coating thicknesses, and or unsatisfactory coating core surface coverage. The defective resin coated core particles obtained at temperatures above the upper limits, while not desired to be limited by theory, are believed to result from, for example, uncontrolled or excessive resin decomposition, and mechanical and or evaporative losses of low molecular weight or low viscosity resin decomposition products.

Under the controlled heating regimes of the processes of the present invention, while not desired to be limited by theory, it is believed that the controlled heating liberates or drives off polar constituents from the resin coating composition. The polar constituents arising, for example, from commercially available Soken polymethylmethacrylate ($MW_w$ 400,00), are believed to be a combination of volatile polymer degradation products, such as, methylmethacrylate monomers, oligomers, and other polar impurities present in the commercially available Soken resin, for example, identified and measured, for example with head space gas chromatographic methods, sulfur containing species, such as, sulfur dioxide($SO_2$), hydrogen sulfide($H_2S$), and carbon disulfide($CS_2$). The sulfur containing species are believed to arise from residuals in the commercial polymerization and purification processing. The residuals are believed to be typical byproducts and are not typically removed by conventional washing or spray drying of the commercial grade polymer product. The elimination or volatilization of the polar impurities is apparently greatly facilitated by heating at elevated temperatures in the processes of the present invention wherein a molten resin state is achieved.

In embodiments heating the resin coated carrier cores in accordance with the present invention can decrease the bulk polarity and dielectric constant of the resin coating. For example the dielectric constant of polymethylmethacrylate prior to heating is about 3.1 and can be reduced by several percent or more as a result of processing in accordance with the present invention. The level of reduction appears to be proportional to the extent of resin decomposition or reduction in the resin molecular weight properties.

In embodiments the resin coated core particles can be prepared prior to the elevated temperature heating regime of the present invention, for example, in a known batch-wise or continuous process. Alternatively, the resin coated core particles can be prepared in situ or just-in-time for the elevated temperature heating regime of the present invention. Thus for example, the resin coated core particles can be prepared by conventional or known powder or liquid coating procedures, such as powder coating at about 180° C. to about 200° C., for example, heating in a rotatory kiln, and soon thereafter the processing temperature can be increased in accordance with the present invention to obtain the desired resin coating modification and improved resin coated core particle properties.

The core particles can be any suitable core material which can withstand the elevated temperatures of the processes of the present invention. Preferred classes of materials are metals, metal alloys, metal oxides, metal-metal oxide mixtures, and the like materials. Examples of suitable core materials include iron powder, steel, nickel, iron, ferrites, including copper zinc ferrite, magnetites, alloy cores, sponge iron, and mixtures thereof.

The core particles can have a volume average diameter of from about 10 to about 250 microns, and preferably have a volume average diameter from about 20 to about 150 microns.

The coating resin can be for example, polymeric acrylates, methacrylates, fluorinated resins, polyesters, urethanes, copolymers thereof, and the like resinous materials, and mixtures thereof. The total weight of the resin coating prior to said heating can be from about 1 to about 40 weight percent of the total weight of the coated carrier core particles.

In embodiments of the present invention there is provided a resin coated carrier prepared by the process comprising:

heating resin coated core particles for a time until the weight average molecular weight of the resin coating decreases.

The present invention embodies developer compositions including resin coated carrier particles prepared in accordance with the present invention in admixture with toner particles.

With respect to imaging applications, toner compositions can be prepared by a number of known methods, such as admixing and heating resin particles such as styrene butadiene copolymers, pigment particles such as magnetite, carbon black, or mixtures thereof, and cyan, yellow, magenta, green, brown, red, or mixtures thereof, and preferably from about 0.5 percent to about 5 percent of charge enhancing additives in a toner extrusion device, such as the ZSK53 available from Wemer Pfleiderer, and removing the formed toner composition from the device. Subsequent to cooling, the toner composition is subjected to grinding utilizing, for example, a Sturtevant micronizer for the purpose of achieving toner particles with a volume median diameter of less than about 25 microns, and preferably of from about 6 to about 12 microns, which diameters are determined by a Coulter Counter. Subsequently, the toner compositions can be classified utilizing, for example, a Donaldson Model B classifier for the purpose of removing toner fines, that is toner particles less than about 4 microns volume median diameter. Alternatively, the toner compositions are ground with a fluid bed grinder equipped with a classifier wheel constructed in accordance with the present invention, and then classified using a classifier equipped with a classifier wheel constructed in accordance with the present invention.

Illustrative examples of resins suitable for toner and developer compositions of the present invention include branched styrene acrylates, styrene methacrylates, styrene butadienes, vinyl resins, including branched homopolymers and copolymers of two or more vinyl monomers; vinyl monomers include styrene, p-chlorostyrene, butadiene, isoprene, and myrcene; vinyl esters like esters of monocarboxylic acids including methyl acrylate, ethyl acrylate, n-butyl acrylate, isobutyl acrylate, dodecyl acrylate, n-octyl acrylate, phenyl acrylate, methyl methacrylate, ethyl methacrylate, and to butyl methacrylate; acrylonitrile, methacrylonitrile, acrylamide; and the like. Preferred toner resins include styrene butadiene copolymers, mixtures thereof, and the like.

Other preferred toner resins include styrene/n-butyl acrylate copolymers, PLIOLITES®; suspension polymerized styrene butadienes, reference U.S. Pat. No. 4,558,108, the disclosure of which is totally incorporated herein by reference.

In toner compositions, the resin particles are present in a sufficient but effective amount, for example from about 70 to about 90 weight percent. Thus, when 1 percent by weight of the charge enhancing additive is present, and 10 percent by weight of pigment or colorant, such as carbon black, is contained therein, about 89 percent by weight of resin is selected. Also, the charge enhancing additive may be coated on the pigment particle. When used as a coating, the charge enhancing additive is present in an amount of from about 0.1 weight percent to about 5 weight percent, and preferably from about 0.3 weight percent to about 1 weight percent.

Numerous well known suitable pigments or dyes can be selected as the colorant for the toner particles including, for example, carbon black like REGAL 330®, nigrosine dye, aniline blue, magnetite, or mixtures thereof. The pigment, which is preferably carbon black, should be present in a sufficient amount to render the toner composition highly colored. Generally, the pigment particles are present in amounts of from about 1 percent by weight to about 20 percent by weight, and preferably from about 2 to about 10 weight percent based on the total weight of the toner composition; however, lesser or greater amounts of pigment particles can be selected.

When the pigment particles are comprised of magnetites, thereby enabling single component toners in some instances, which magnetites are a mixture of iron oxides ($FeO.Fe_2O_3$) including those commercially available as MAPICO BLACK®, they are present in the toner composition in an amount of from about 10 percent by weight to about 70 percent by weight, and preferably in an amount of from about 10 percent by weight to about 50 percent by weight. Mixtures of carbon black and magnetite with from about 1 to about 15 weight percent of carbon black, and preferably from about 2 to about 6 weight percent of carbon black, and magnetite, such as MAPICO BLACK®, in an amount of, for example, from about 5 to about 60, and preferably from about 10 to about 50 weight percent can be selected.

There can also be blended with the toner compositions of the present invention external additive particles including flow aid additives, which additives are usually present on the surface thereof. Examples of these additives include colloidal silicas, such as AEROSIL®, metal salts and metal salts of fatty acids inclusive of zinc stearate, aluminum oxides, cerium oxides, and mixtures thereof, which additives are generally present in an amount of from about 0.1 percent by weight to about 10 percent by weight, and preferably in an amount of from about 0.1 percent by weight to about 5 percent by weight. Several of the aforementioned additives are illustrated in U.S. Pat. Nos. 3,590,000 and 3,800,588, the disclosures of which are totally incorporated herein by reference.

With further respect to the present invention, colloidal silicas, such as AEROSIL®, can be surface treated with the charge additives in an amount of from about 1 to about 30 weight percent and preferably 10 weight percent followed by the addition thereof to the toner in an amount of from 0.1 to 10 and preferably 0.1 to 1 weight percent.

Also, there can be included in the toner compositions low molecular weight waxes, such as polypropylenes and polyethylenes commercially available from Allied Chemical and Petrolite Corporation, EPOLENE N-15® commercially available from Eastman Chemical Products, Inc., VISCOL 550-P®, a low weight average molecular weight polypropylene available from Sanyo Kasei K.K., and similar materials. The commercially available polyethylenes selected have a molecular weight of from about 1,000 to about 1,500, while the commercially available polypropylenes utilized for the toner compositions are believed to have a molecular weight of from about 4,000 to about 5,000. Many of the polyethylene and polypropylene compositions useful in the present invention are illustrated in British Patent No. 1,442,835, the disclosure of which is totally incorporated herein by reference.

The low molecular weight wax materials are optionally present in the toner composition or the polymer resin beads of the present invention in various amounts, however, generally these waxes are present in the toner composition in an amount of from about 1 percent by weight to about 15 percent by weight, and preferably in an amount of from about 2 percent by weight to about 10 percent by weight and may in embodiments function as fuser roll release agents.

Encompassed within the scope of the present invention are colored toner and developer compositions comprised of toner resin particles, carrier particles, the charge enhancing additives illustrated herein, and as pigments or colorants red, blue, green, brown, magenta, cyan and/or yellow particles, as well as mixtures thereof. More specifically, with regard to the generation of color images utilizing a developer composition with charge enhancing additives, illustrative examples of magenta materials that may be selected as pigments include, for example, 2,9-dimethylsubstituted quinacridone and anthraquinone dye identified in the Color Index as CI 60710, CI Dispersed Red 15, diazo dye identified in the Color Index as CI 26050, CI Solvent Red 19, and the like. Illustrative examples of cyan materials that may be used as pigments include copper tetra-4-(octadecyl sulfonamido) phthalocyanine, X-copper phthalocyanine pigment listed in the Color Index as CI 74160, CI Pigment Blue, and Anthrathrene Blue, identified in the Color Index as CI 69810, Special Blue X-2137, and the like; while illustrative examples of yellow pigments that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33, 2,5-dimethoxy-4-sulfonanilide phenylazo-4'-chloro-2,5-dimethoxy acetoacetanilide, and Permanent Yellow FGL. The aforementioned pigments are incorporated into the toner composition in various suitable effective amounts providing the objectives of the present invention are achieved. In one embodiment, these colored pigment particles are present in the toner composition in an amount of from about 2 percent by weight to about 15 percent by weight calculated on the weight of the toner resin particles.

The toner composition of the present invention can be prepared by a number of known methods as indicated herein including extrusion melt blending the toner resin particles, pigment particles or colorants, and a charge enhancing additive, followed by mechanical attrition. Other methods include those well known in the art such as spray drying, melt dispersion, emulsion aggregation, and extrusion processing. Also, as indicated herein the toner composition without the charge enhancing additive in the bulk toner can be prepared, followed by the addition of charge additive surface treated colloidal silicas.

The toner compositions are usually jetted and classified subsequent to preparation to enable toner particles with a preferred average diameter of from about 5 to about 25 microns, more preferably from about 8 to about 12 microns, and most preferably from about 5 to about 8 microns. Also, the toner compositions preferably possess triboelectric charge levels of from about 0.1 to about 2 femtocoulombs per micron as determined by the known charge spectrograph. Admix time for toners are preferably from about 5 seconds to 1 minute, and more specifically from about 5 to about 15 seconds as determined by the known charge spectrograph. These toner compositions with rapid admix characteristics enable, for example, the development of images in electrophotographic imaging apparatuses, which images have substantially no background deposits thereon, even at high toner dispensing rates in some instances, for instance exceeding 20 grams per minute; and further, such toner compositions can be selected for high speed electrophotographic apparatuses, that is those exceeding 70 copies per minute.

Also, the toner compositions used in embodiments of the present invention possess desirable narrow charge distributions, optimal charging triboelectric values, preferably of from 10 to about 40, and more preferably from about 10 to about 35 microcoulombs per gram as determined by the known Faraday Cage methods with from about 0.1 to about 5 weight percent in one embodiment of the charge enhancing additive; and rapid admix charging times as determined in the charge spectrograph of less than 15 seconds, and more preferably in some embodiments from about 1 to about 14 seconds. Other toner compositions include colored toners, single component toners, mufticomponent toners, toners containing special performance additives, and the like.

For the formulation of developer compositions, there are mixed with the toner particles carrier components, particularly those that are capable of triboelectrically assuming an opposite polarity to that of the toner composition. Accordingly, the carrier particles are selected to be of a negative polarity enabling the toner particles, which are positively charged, to adhere to and surround the carrier particles. Illustrative examples of carrier particles include iron powder, steel, nickel, iron, ferrites, including copper zinc ferrites, and the like. Additionally, there can be selected as carrier particles nickel berry carriers as illustrated in U.S. Pat. No. 3,847,604, the disclosure of which is totally incorporated herein by reference. The selected carrier particles are coated with resin in accordance with the present invention. The resin coating generally contains, for example, terpolymers of styrene, methylmethacrylate, and a silane, such as triethoxy silane, reference U.S. Pat. No. 3,526,533, U.S. Pat. No. 4,937,166, and U.S. Pat. No. 4,935,326, the disclosures of which are totally incorporated herein by reference, including for example KYNAR® and polymethylmethacrylate mixtures (40/60). Coating weights can vary as indicated herein; generally, however, from about 0.3 to about 2, and preferably from about 0.5 to about 1.5 weight percent coating weight is selected.

Furthermore, the diameter of the carrier particles, preferably spherical in shape, is generally from about 50 microns to about 1,000 microns, and in embodiments about 175 microns thereby permitting them to possess sufficient density and inertia to avoid adherence to the electrostatic images during the development process. The carrier component can be mixed with the toner composition in various suitable combinations, however, best results are obtained when about 1 to 5 parts per toner to about 10 parts to about 200 parts by weight of carrier are selected.

The toner and developer compositions can be selected for use in electrostatographic imaging apparatuses containing therein conventional photoreceptors providing that they are capable of being charged positively or negatively. Thus, the toner and developer compositions can be used with layered photoreceptors that are capable of being charged negatively, such as those described in U.S. Pat. No. 4,265,990, the disclosure of which is totally incorporated herein by reference. Illustrative examples of inorganic photoreceptors that may be selected for imaging and printing processes include selenium; selenium alloys, such as selenium arsenic, selenium tellurium and the like; halogen doped selenium substances; and halogen doped selenium alloys.

In embodiments, the processes of the present invention can be selected for and employed in preparing polymer coated core particulates for electrophotographic carriers where the coating can include, but is not limited to, crystalline, semicrystalline, and amorphous polymeric materials, and mixtures thereof.

The invention will further be illustrated in the following non limiting Examples, it being understood that these Examples are intended to be illustrative only and that the invention is not intended to be limited to the materials, conditions, process parameters, and the like, recited herein. Parts and percentages are by weight unless otherwise indicated.

EXAMPLE I

Resin Coating of Core Particles and Comparative Evaluation of Coated Core Particles A 77 micron average diameter steel core was mixed with polymethylmethacrylate at a coating weight of about 1 weight percent of the core and then two identical separated portions were processed for about 5 to about 60 minutes, preferably for about 30 minutes, in a 7 inch kiln about at 390° F. (199° C.) and about 460° F. (238° C.), respectively. The resulting coated core particles were mixed with a cyan color toner and thereafter the respective triboelectrification values were measured from a 30 minute roll mill experiment. Developer aging properties were evaluated for the developers by roll milling for an additional 90 minutes. The results indicated that the developer incorporating the coated core obtained from the higher temperature resin coat degradation regime maintained higher tribo characteristics compared to the developer containing the resin coated core prepared with the lower or conventional temperature regime. The conductivity of the resulting coated beads was about $10^{-14}$ mho per centimeter compared to the coated beads prior to heating which had a conductivity of $10^{-11}$ mho per centimeter.

EXAMPLE II

Magnetic Toner and Developer Preparation and Evaluation

A polymer resin (74 weight percent of the total mixture) obtained by free radical polymerization of mixtures of styrene and butadiene may be melt extruded with 10 weight percent of REGAL 330® carbon black and 16 weight percent of MAPICO BLACK® magnetite at 120° C., and the extrudate pulverized in a Waring blender and jetted and classified to 8 micron number average sized particles as measured by a Coufter counter with a classifier equipped with a classifier wheel. A positively charging magnetic toner may be prepared by surface treating the jetted toner (2 grams) with 0.12 gram of a 1:1 weight ratio of AEROSIL R972® (Degussa) and TP-302 a naphthalene sulfonate and quatemary ammonium salt (Nachem/Hodogaya SI) charge control agent.

Developer compositions may then be prepared by admixing 3.34 parts by weight of the aforementioned toner composition with 96.66 parts by weight of either the high or low temperature regime coated carriers of Example I. Cascade development may be used to develop a Xerox Model D photoreceptor using a "negative" target. The light exposure may be set between 5 and 10 seconds and a negative bias used to dark transfer the positive toned images from the photoreceptor to paper.

Fusing evaluations may be carried out with a Xerox Corporation 5028® soft silicone roll fuser, operated at 7.62 cm (3 inches) per second.

The actual fuser roll temperatures may be determined using an Omega pyrometer and was checked with wax paper indicators. The degree to which a developed toner image adhered to paper after fusing is evaluated using a Scotch® tape test. The fix level is expected to be excellent and comparable to that fix obtained with toner compositions prepared from other methods for preparing toners. Typically greater than 95 percent of the toner image remains fixed to the copy sheet after removing a tape strip as determined by a densitometer. Alternatively, the fixed level may be quantitated using the known crease test, reference the aforementioned U.S. Pat. No. 5,312,704.

Images may be developed in a xerographic imaging test fixture with a negatively charged layered imaging member comprised of a supporting substrate of aluminum, a photogenerating layer of trigonal selenium, and a charge transport layer of the aryl amine N,N'-diphenyl-N,N'-bis(3-methylphenyl)1,1'-biphenyl-4,4'-diamine, 45 weight percent, dispersed in 55 weight percent of the polycarbonate MAKROLON®, reference U.S. Pat. No. 4,265,990, the disclosure of which is totally incorporated herein by reference; images for toner compositions prepared from the copolymers derived from for example, Example XI in the '990 patent are expected to be of excellent quality with no background deposits and of high resolution over an extended number of imaging cycles exceeding, it is believed, about 75,000 imaging cycles.

Other modifications of the present invention may occur to one of ordinary skill in the art based upon a review of the present application and these modifications, including equivalents thereof, are intended to be included within the scope of the present invention.

What is claimed is:

1. A process comprising:

heating resin coated core particles for a time until the weight average molecular weight of the resin coating declines from about 1 to about 90 percent, and the resulting coated core particles possess a resin coating with a substantially uniform thickness and excellent coating adhesion to the core, and the coated core particles possess improved triboelectric charge properties.

2. A process in accordance with claim 1, wherein the heating time is from about 5 minutes to about 10 hours.

3. A process in accordance with claim 1, wherein the resin is a polymethylmethacrylate.

4. A process in accordance with claim 3, wherein the heating changes the triboelectric charge of the coated core particles from about 10 to about 60 microcoulombs per gram before heating to a range of from about 30 to about 45 microcoulombs per gram after heating.

5. A process in accordance with claim 3, wherein the thickness of the resin coating of the resulting coated core particles is from about 0.01 to about 0.1 microns.

6. A process in accordance with claim 3, wherein the weight average molecular weight of the polymethylmethacrylate prior to heating is from about 350,000 to about 450,000, and the molecular weight distribution is from about 4 to about 6, and the weight average molecular weight of the polymethylmethacrylate after heating is from about 70,000 to about 140,000, and the molecular weight distribution is from about 2 to about 4.

7. A process in accordance with claim 3, wherein the heating is at from about 190° C. to about 270° C.

8. A process in accordance with claim 3, wherein said heating liberates polar constituents from the resin coating.

9. A process in accordance with claim 3, wherein said heating decreases the bulk polarity and dielectric constant of the resin coating.

10. A process in accordance with claim 3, wherein prior to said heating, the resin coated core particles are prepared by powder coating at about 180° C. to about 200° C.

11. A process in accordance with claim 1, wherein said heating is accomplished in a rotatory kiln.

12. A process in accordance with claim 1, wherein the core particles are selected from the group consisting of iron powder, steel, nickel, iron, ferrites, including copper zinc ferrites, ferrites, magnetites, alloy cores, sponge iron, and the mixtures thereof.

13. A process in accordance with claim 1, wherein the coating resin is selected from the group consisting of polymeric acrylates, methacrylates, fluorinated resins, polyesters, urethanes, copolymers thereof, and mixtures thereof.

14. A process in accordance with claim 1, wherein the core particles have a volume average diameter of from about 10 to about 150 microns.

15. A process in accordance with claim 1, wherein the total weight of the resin coating prior to said heating is from about 1 to about 40 weight percent of the total weight of the coated carrier core particles.

16. A resin coated carrier prepared by the process comprising:

heating resin coated core particles for a time until the weight average molecular weight of the resin coating decreases from about 1 to about 90 percent, and the resulting coated core particles possess a resin coating with a substantially uniform thickness and excellent coating adhesion to the core, and the coated core particles possess improved triboelectric charge properties.

17. A carrier in accordance with claim 16, wherein the resin coating comprises a polymethylmethacrylate polymer.

18. A developer composition comprising resin coated carrier particles prepared in accordance with claim 16, and toner particles.

* * * * *